US011454472B2

(12) United States Patent
Kung et al.

(10) Patent No.: US 11,454,472 B2
(45) Date of Patent: Sep. 27, 2022

(54) NO-BULLET NO-FIRING STRUCTURE OF TOY GUN

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 17/461,334

(22) Filed: Aug. 30, 2021

(65) Prior Publication Data

US 2022/0163285 A1 May 26, 2022

(30) Foreign Application Priority Data

Nov. 25, 2020 (TW) ..... 109215519

(51) Int. Cl.
*F41B 11/89* (2013.01)
*F41B 11/51* (2013.01)
*F41B 11/723* (2013.01)

(52) U.S. Cl.
CPC ..... *F41B 11/89* (2013.01); *F41B 11/51* (2013.01); *F41B 11/723* (2013.01)

(58) Field of Classification Search
CPC ..... F41B 11/89; F41B 11/51; F41B 11/723; F41B 11/70; F41B 11/721; F41B 11/00; F41B 11/60; F41A 33/06; F41A 3/72; F41A 9/03; F41A 9/23
USPC ..... 124/71–77
See application file for complete search history.

(56) References Cited

U.S. PATENT DOCUMENTS

| | | | | |
|---|---|---|---|---|
| 1,516,483 | A * | 11/1924 | Krafft | F41A 9/23 124/75 |
| 6,810,870 | B1 * | 11/2004 | Hu | F41B 11/721 124/76 |
| 9,261,324 | B1 * | 2/2016 | Liang | F41C 23/14 |
| 10,852,098 | B1 * | 12/2020 | Wei | F41C 23/16 |
| 10,989,493 | B1 * | 4/2021 | Kung | F41A 33/06 |
| 2012/0208430 | A1 * | 8/2012 | Kung | F41B 11/646 446/473 |
| 2019/0360775 | A1 * | 11/2019 | Kung | F41B 11/89 |
| 2021/0278155 | A1 * | 9/2021 | Kung | F41B 11/51 |

* cited by examiner

*Primary Examiner* — Michael D David
(74) *Attorney, Agent, or Firm* — Chun-Ming Shih; HDLS IPR Services

(57) ABSTRACT

The no-bullet no-firing structure of the toy gun is disclosed. The toy gun has an impact unit and the no-bullet no-firing structure. The structure has a barrel component, a switch unit and a magazine unit. The switch unit has a pull lever with an abut lever, an elastic member with an elastic arm, and a push member. The magazine unit has a magazine, a bullet and a pulled member. The pulled member is pushed by the bullet to push the abut lever to make the pull lever, the push member and the impact unit be aligned on a same linear line. When no bullet is in the magazine, the abut lever is pushed by the elastic arm to rotate the pull lever pivotally, and the pull lever drives the push member to swing to make the toy gun be unable to fire.

11 Claims, 12 Drawing Sheets

NO-BULLET NO-FIRING STRUCTURE OF TOY GUN

BACKGROUND

Technical Field

This disclosure relates to a toy gun structure, particularly to a toy gun with a no-bullet no-firing structure.

Description of Related Art

A toy gun fires a bullet with a driving method of utilizing gas or electricity, the electric-driven toy gun fires the bullet through a pressure generated from a piston being rapidly pushed by a motor and a gear set, and the gas-driven toy gun fires the bullet through a pressure generated from a liquidized gas (for example propane, butane or carbon dioxide) stored in a gas storing cylinder being vaporized, thus an effect of simulating firing of a real gun may be achieved.

However, when there is no bullet loaded in a magazine, the trigger may still be pulled to operate the bolt, thus a no-bullet no-firing mechanism may be installed for a purpose of further increasing a simulating effect of the toy gun. The electric-driven toy gun utilizes a sensing element to terminate the power supply for stopping the operation of a motor, and the gas-driven toy gun may only achieve a no-firing effect through a mechanical design, the mechanical design is complicated and occupies more space, thus it shall be improved.

Accordingly, the applicant of the present disclosure has devoted himself for improving the mentioned disadvantages.

SUMMARY

The present disclosure is to provide a toy gun with a no-bullet no-firing structure, thereby further increasing a simulating effect relative to a real gun.

The present disclosure provides a toy gun with a no-bullet no-firing structure, the toy gun has an impact unit and the no-bullet no-firing structure. The no-bullet no-firing structure has a barrel component, a switch unit and a magazine unit. The switch unit is disposed in the barrel component, and has a pull lever, an elastic member and a push member. The pull lever is connected pivotally with the barrel component and has an abut lever. The elastic member is fastened on the barrel component and has an elastic arm. The push member is connected slidably to the pull lever, and the elastic arm elastically presses the abut lever. The magazine unit is disposed on the barrel component and has a magazine, at least one bullet and a pulled member. The bullet is disposed in the magazine, the pulled member is connected pivotally in the magazine corresponding to the abut lever. The pulled member is pushed by the bullet to push the abut lever to make the pull lever, the push member and the impact unit be aligned on a same linear line. The impact unit is used to impact the push member to fire the bullet. When no bullet is in the magazine, the abut lever is pushed by the elastic arm to rotate the pull lever pivotally, and the pull lever drives the push member to jointly swing toward a direction away from the impact unit to make the toy gun be unable to fire.

More effects are provided by the present disclosure as follows. With a position limiting notch and a slide slot, the push member slides restrictedly to prevent from being loosened. With a first pivotal shaft of the pull lever and a pivotal hole of the barrel component, the pull lever is connected pivotally on the barrel component. With a second pivotal shaft of the pulled member and a pivotal slot of the magazine, the pulled member is connected pivotally on the magazine. With a top cover covering the barrel component, the elastic member and the pull lever are clamped and fastened to prevent from being released. With a side cover covering an outer side of the pulled member, the pulled member is clamped to prevent from being released. With a firing switch member disposed on the barrel component, a user may freely select to switch for using a no-bullet no-firing function.

DETAILED DESCRIPTION

Figure 1:
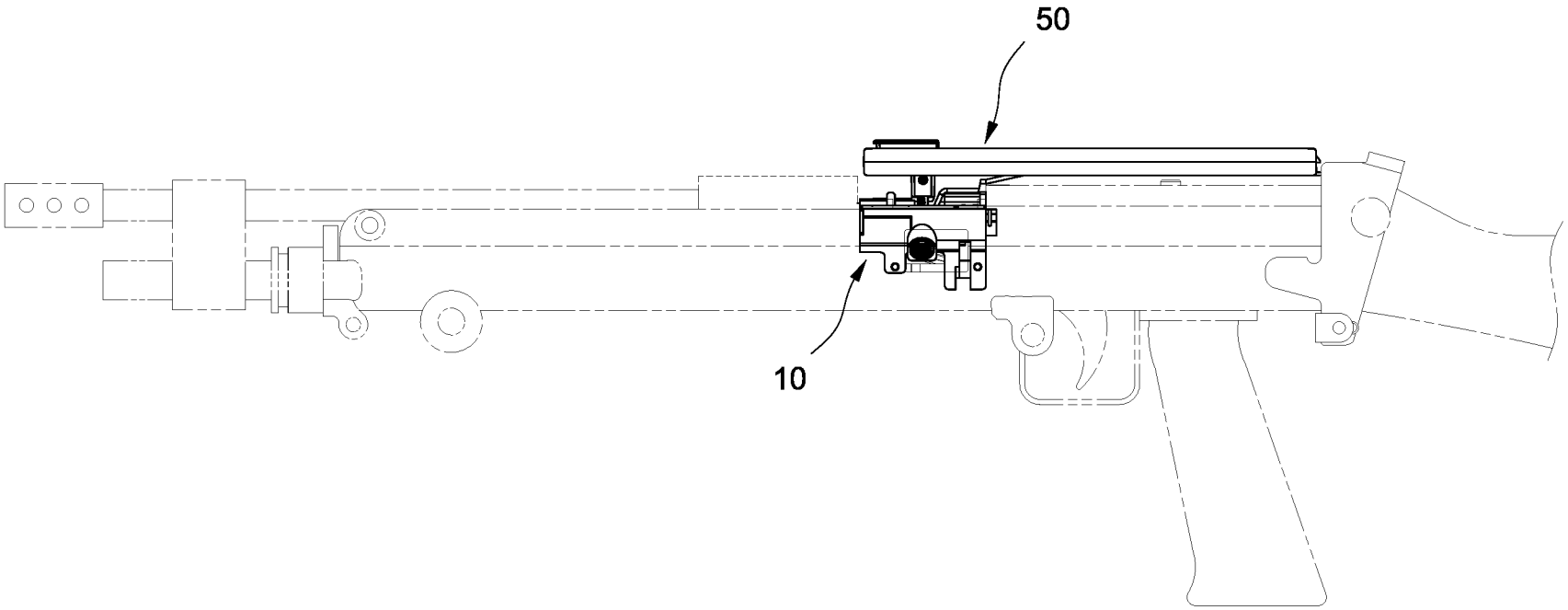
FIG. 1 is a side view showing a location where the no-bullet no-firing structure being disposed in a toy gun according to the present disclosure.
Figure 2:
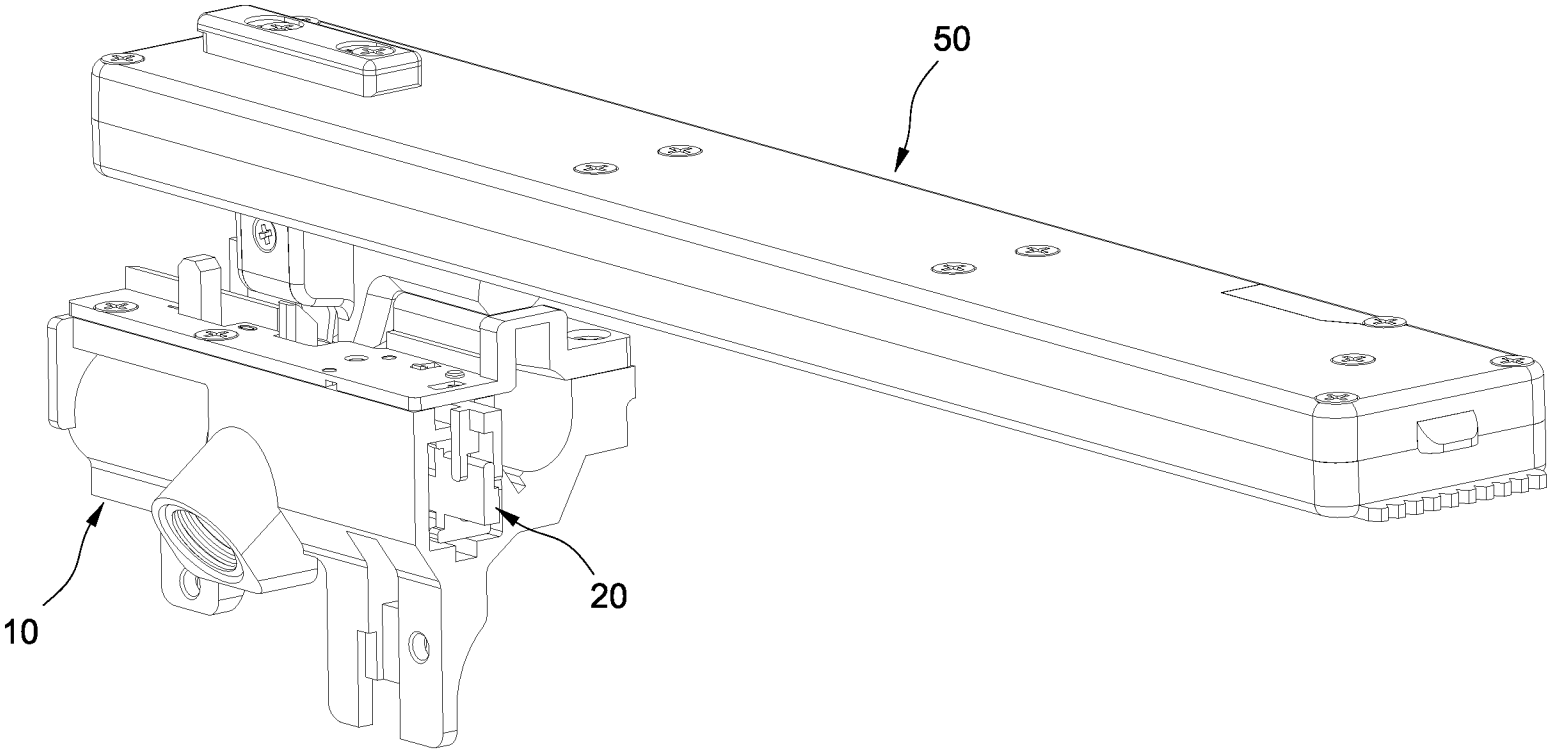
FIG. 2 is a perspective view showing the appearance according to the present disclosure.
Figure 3:
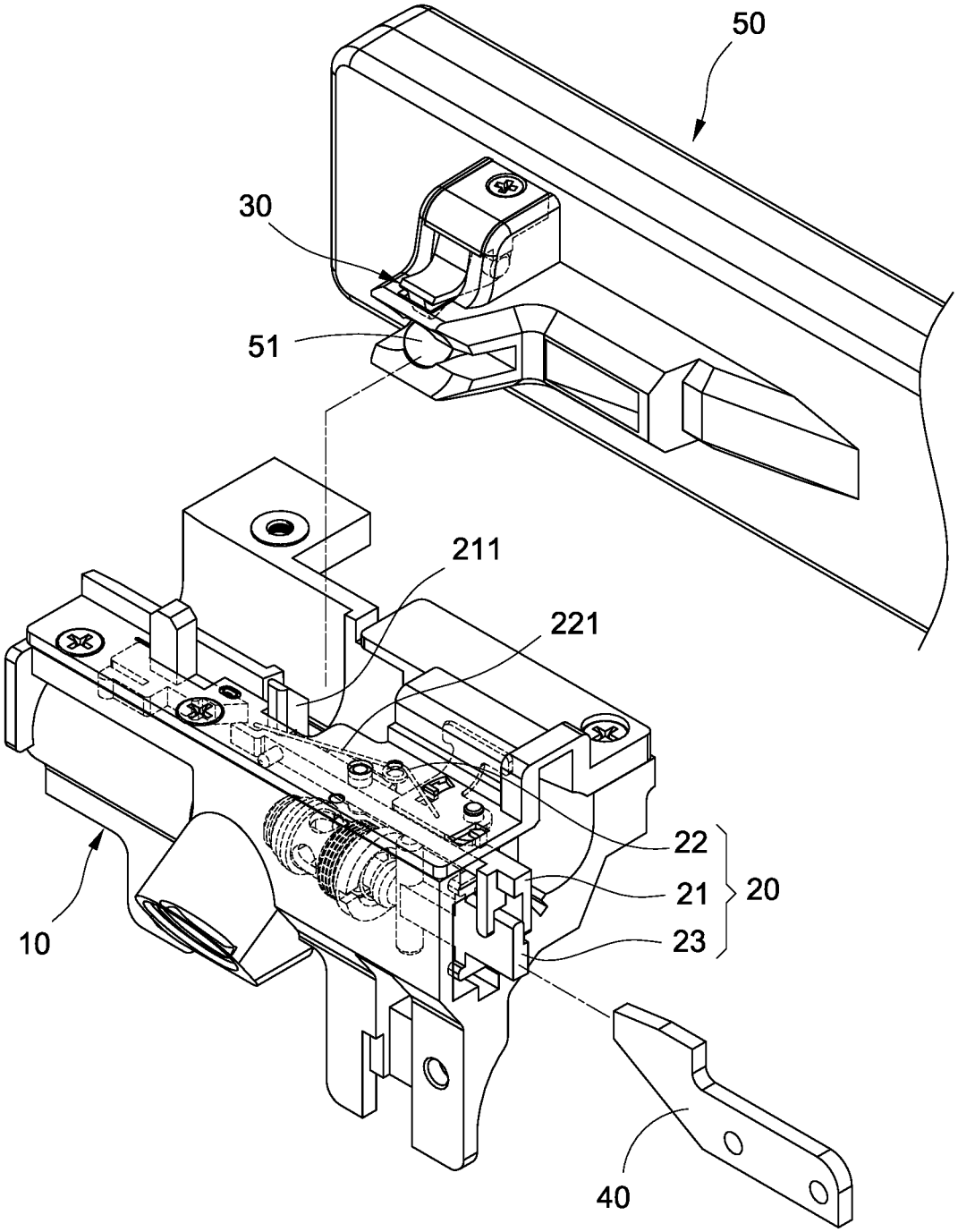
FIG. 3 is a perspective exploded view according to the present disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer from FIG. 1 to FIG. 5, the present disclosure provides a toy gun with a no-bullet no-firing structure. The toy gun has an impact unit 40, and the no-bullet no-firing structure has a barrel component 10, a switch unit 20 and a magazine unit.

The switch unit 20 is disposed in the barrel component 10 and has a pull lever 21, an elastic member 22 and a push member 23. The pull lever 21 is connected pivotally with the barrel component 10 and has an abut lever 211. The elastic member 22 is fastened in the barrel component 10 and has an elastic arm 221. The push member 23 is connected slidably to the pull lever 21, and the elastic arm 221 elastically presses the abut lever 211. The magazine unit is disposed on the barrel component 10 and has a magazine 50, at least one bullet 51 and a pulled member 30. The bullet 51 is disposed in the magazine 50, the pulled member 30 is connected pivotally in the magazine 50 corresponding to the abut lever 211. The pulled member 30 is pushed by the bullet 51 to push the abut lever 211 to make the pull lever 21, the push member 23 and the impact unit 40 be aligned on the same linear line. The impact unit 40 is used for impacting the push member 23 to fire the bullet 51. When no bullet 51 is in the magazine 50, the abut lever 211 is pushed by the elastic arm 221 to enable the pull lever 21 to pivotally rotate, and the pull lever 21 drives the push member 23 to jointly swing toward a direction away from the impact unit 40, thus the toy gun is unable to fire.

Figure 6:
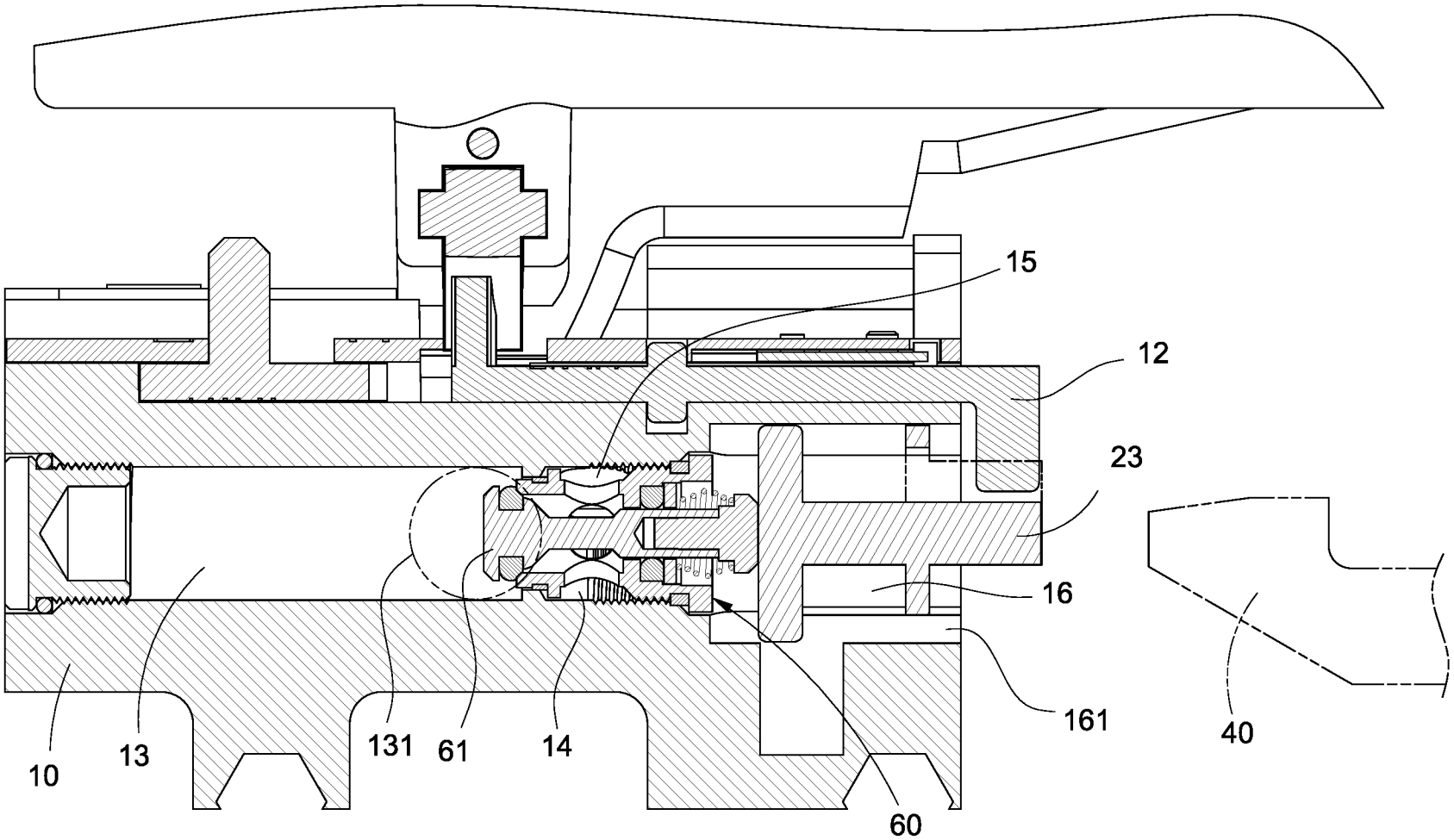
FIG. 6 is a cross sectional side view showing an operating status according to the present disclosure.
Figure 7:
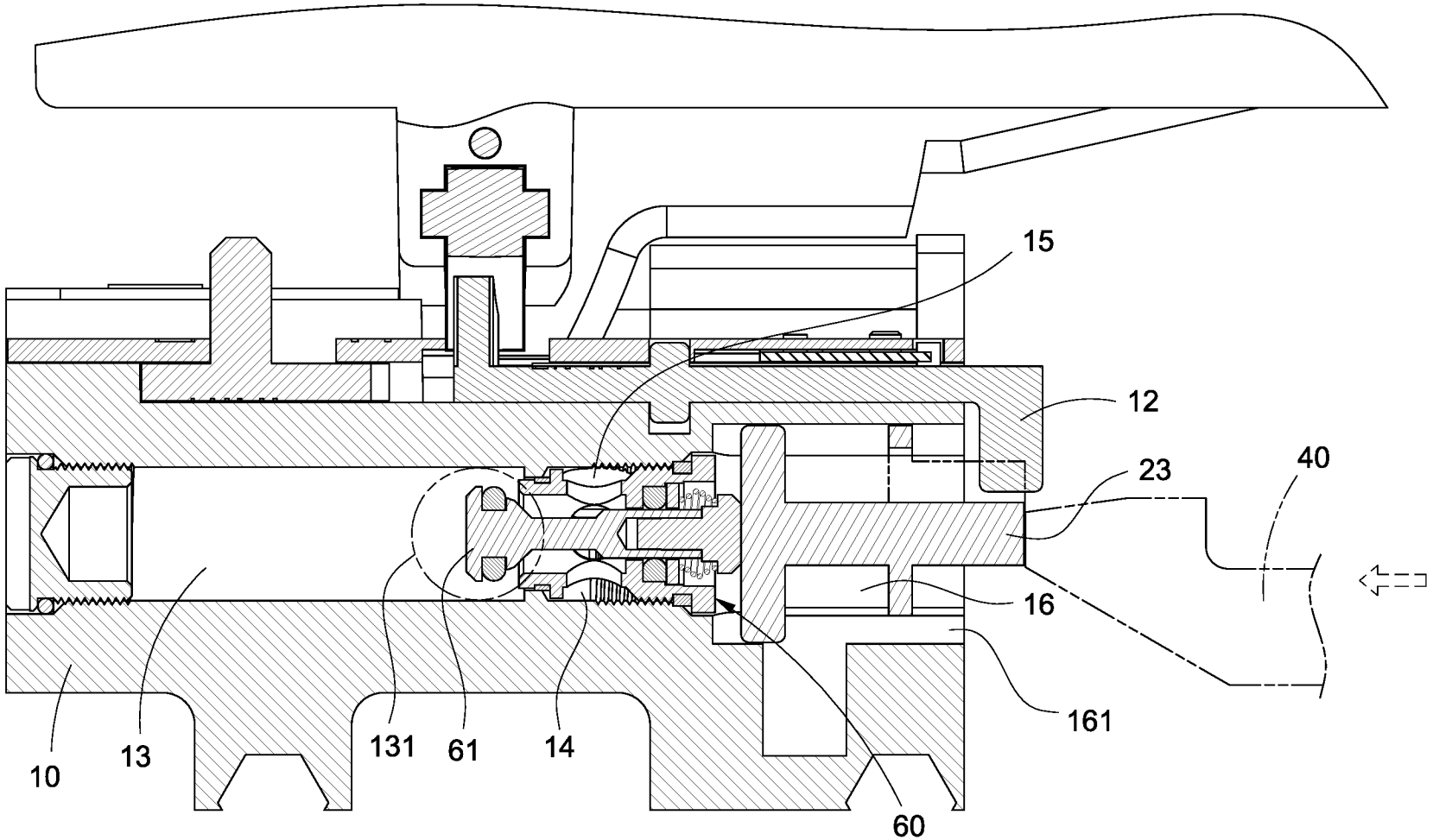
FIG. 7 is a cross sectional side view showing another operating status according to the present disclosure.

Details are provided as follows. The toy gun further has a gas inlet valve 60, and the barrel component 10 has a gas chamber 13, a connection hole 131, an accommodation slot 14, a gas channel 15 and an action chamber 16. The connection hole 131 communicates with the gas chamber 13 and is connected to a plastic pipe (not shown in figures) for filling the liquidized gas into the gas chamber 13. The liquidized gas may be propane, butane or carbon dioxide. The gas inlet valve 60 is screwed in the accommodation slot 14 and used for controlling the communication between the gas chamber 13 and the gas channel 15. Please refer to FIG. 6, the gas inlet valve 60 has a push lever 61, and the push member 23 is disposed in the action chamber 16 and attached to the push lever 61. Please refer to FIG. 7, when a trigger (not shown in figures) of the toy gun is pulled, the impact unit 40 impacts the push member 23, the push member 23 pushes the push lever 61 to open the gas inlet valve 60 to make the gas chamber 13 and the gas channel 15 be communicated, at this moment, the liquidized gas in the gas chamber 13 is filled into the gas channel 15 to make the bullet 51 be fired through the pressure generated from the vaporization of the gas.

Details are provided as follows. Please refer to FIG. 5, the pull lever 21 has a first pivotal shaft 212, the barrel component 10 has a pivotal hole 11 for the first pivotal shaft 212 to be connected pivotally. The abut lever 211 is formed on one end of the pull lever 21, and a position limiting notch 213 is formed on another end of the pull lever 21. A slide slot 161 is formed in the action chamber 16, and two ends of the push member 23 are respectively formed with a first slide part 231 and a second slide part 232. The first slide part 231 is slidably restricted in the position limiting notch 213, the second slide part 232 is slidably restricted in the slide slot 161, so that the push member 23 may be restricted and slide in the position limiting notch 213 and the slide slot 161.

Figure 5:
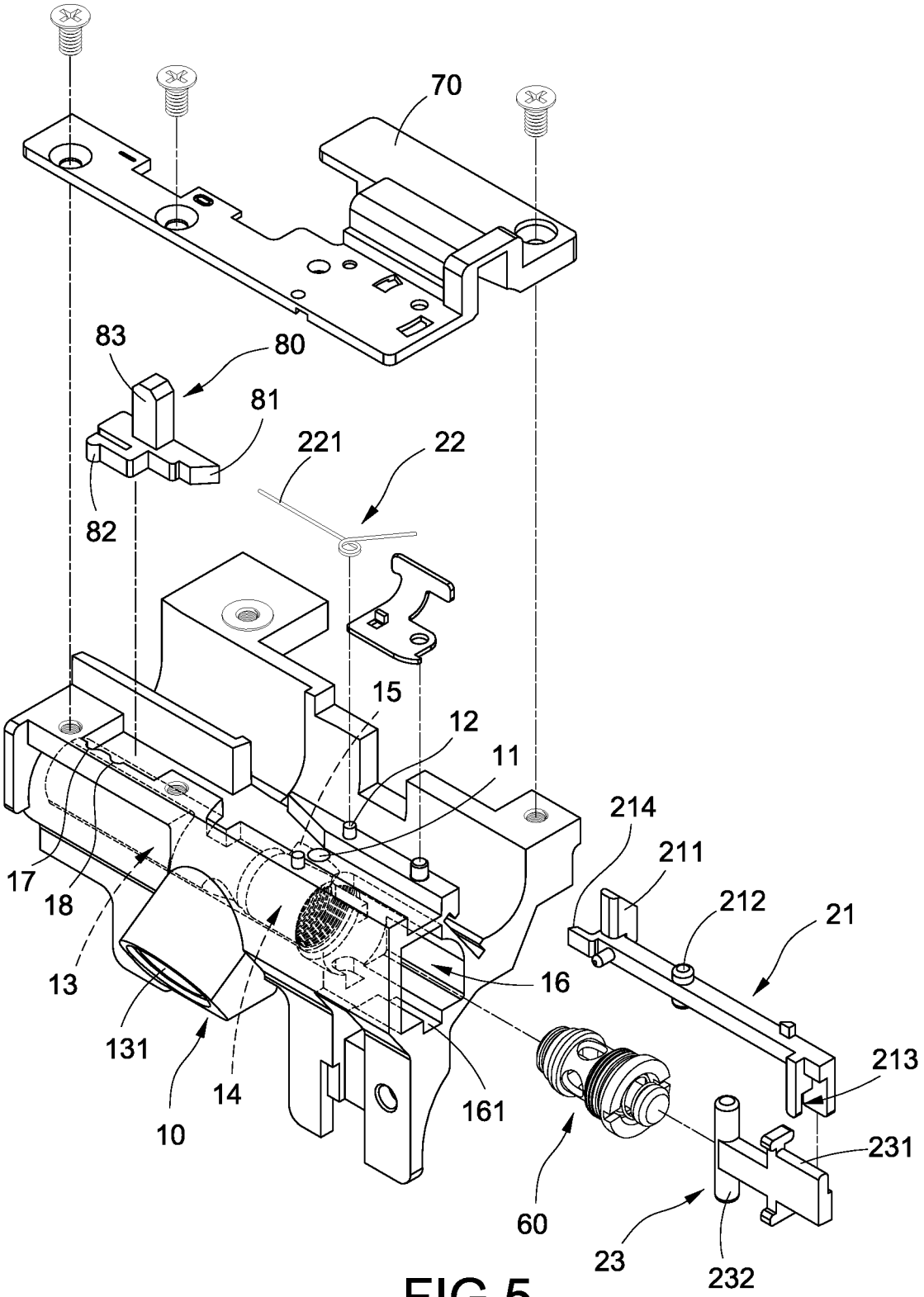
FIG. 5 is a perspective exploded view according to the present disclosure.
Figure 8:
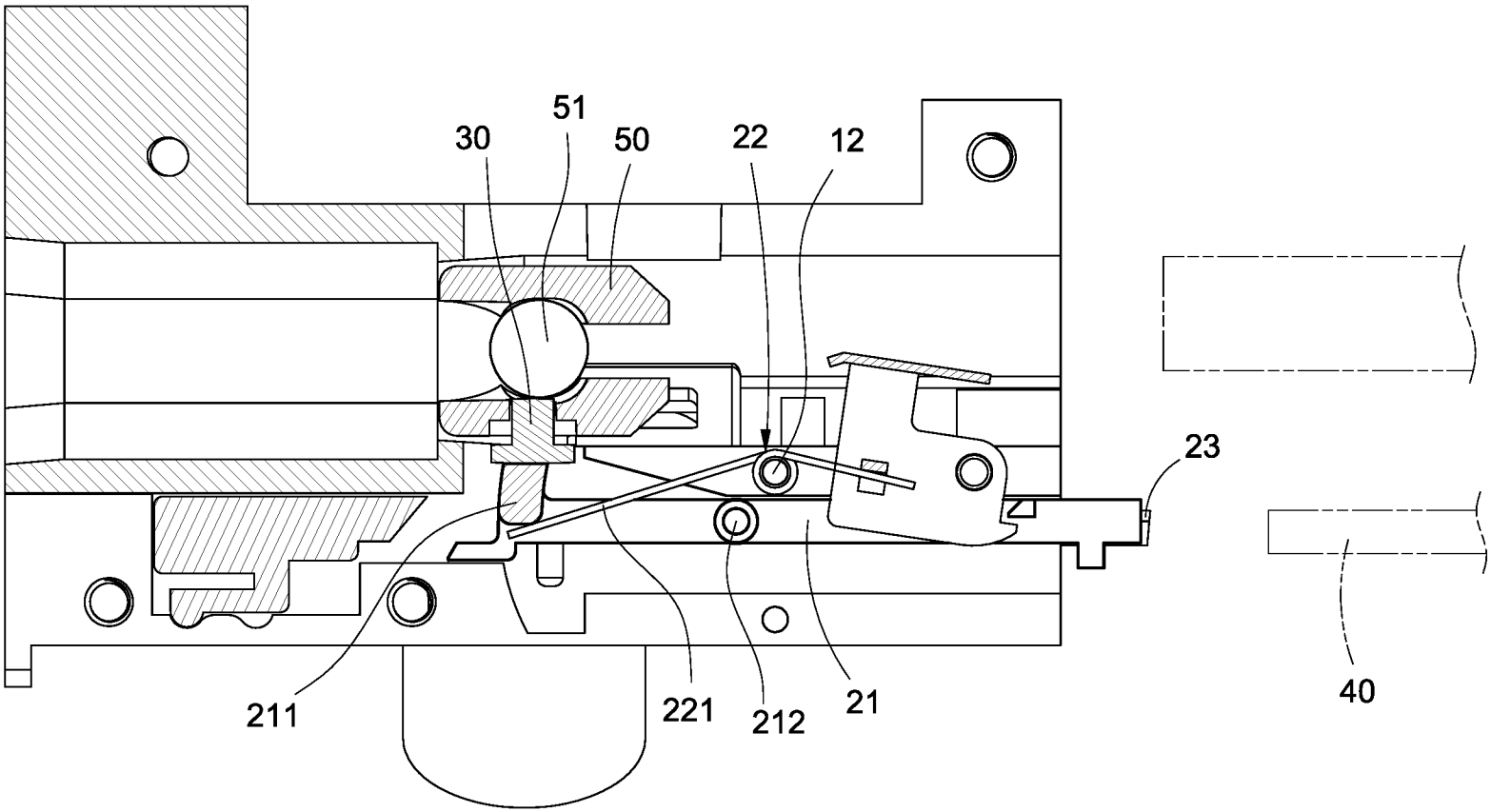
FIG. 8 is a cross sectional top view showing the magazine being loaded with the bullet according to the present disclosure.
Figure 9:
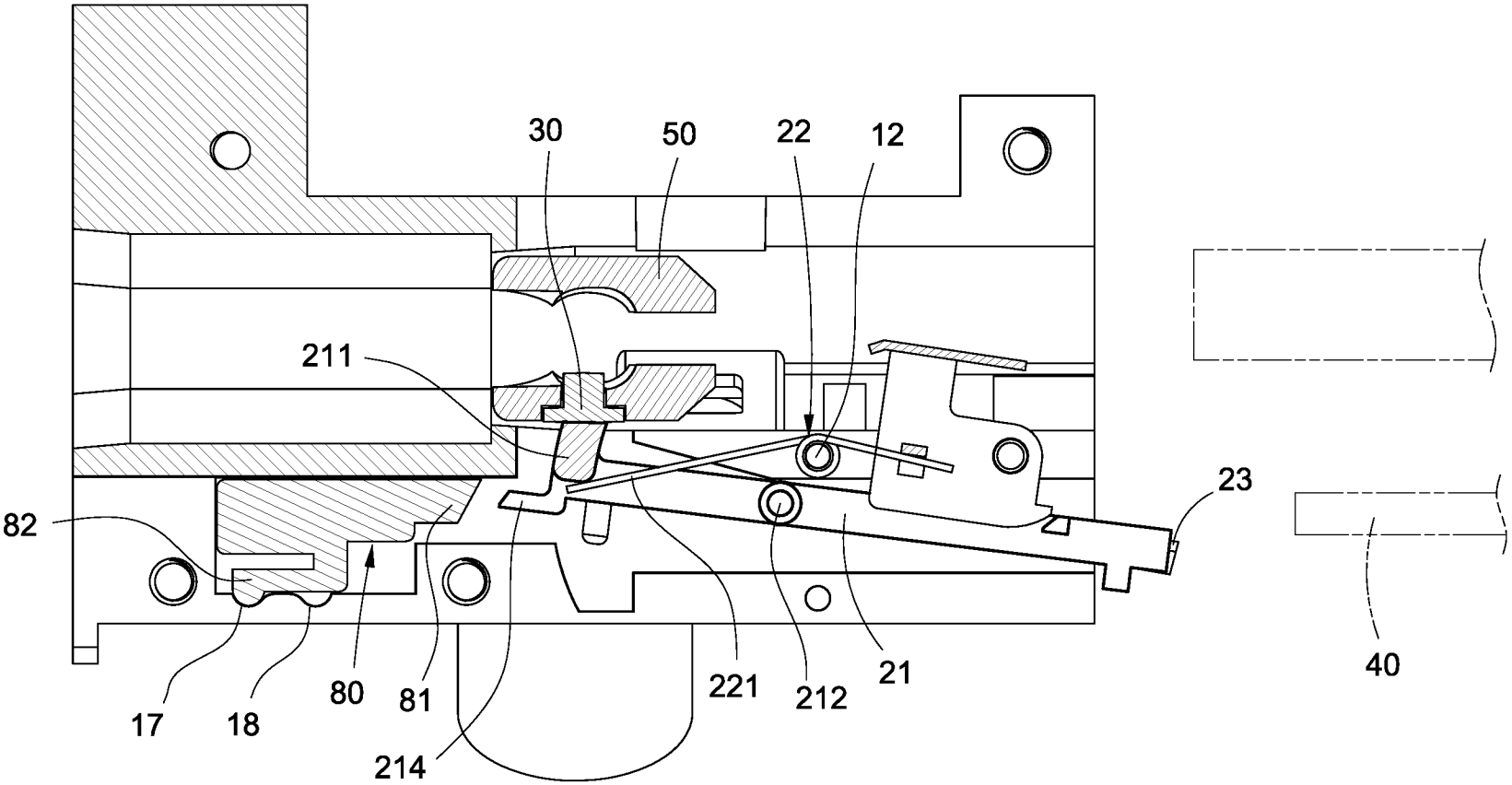
FIG. 9 is a cross sectional top view showing the magazine not being loaded with the bullet according to the present disclosure.

Please refer to FIG. 5, FIG. 8 and FIG. 9, the elastic member 22 of the present disclosure is a torsion spring, and a round column 12 sleeved by the elastic member 22 is convexly formed on the barrel component 10. The abut lever 211 is elastically pressed by an elastic force provided by the elastic arm 221. As shown in FIG. 8, when the bullet 51 is loaded in the magazine 50, the bullet 51 outwardly pushes the pulled member 30, the abut lever 211 is outwardly pushed by the pulled member 30, so that the pull lever 21, the push member 23 and the impact unit 40 are aligned at the same linear line. As shown in FIG. 9, when no bullet 51 is loaded in the magazine 50, the pulled member 30 is in a released status, and the abut lever 211 is not pushed by the pulled member 30, thus the pull lever 21 and the push member 23 are pivotally rotated through the elastic arm 211 for being staggeringly arranged with the impact unit 40, and the impact unit 40 may not impact the push member 23.

Figure 4:
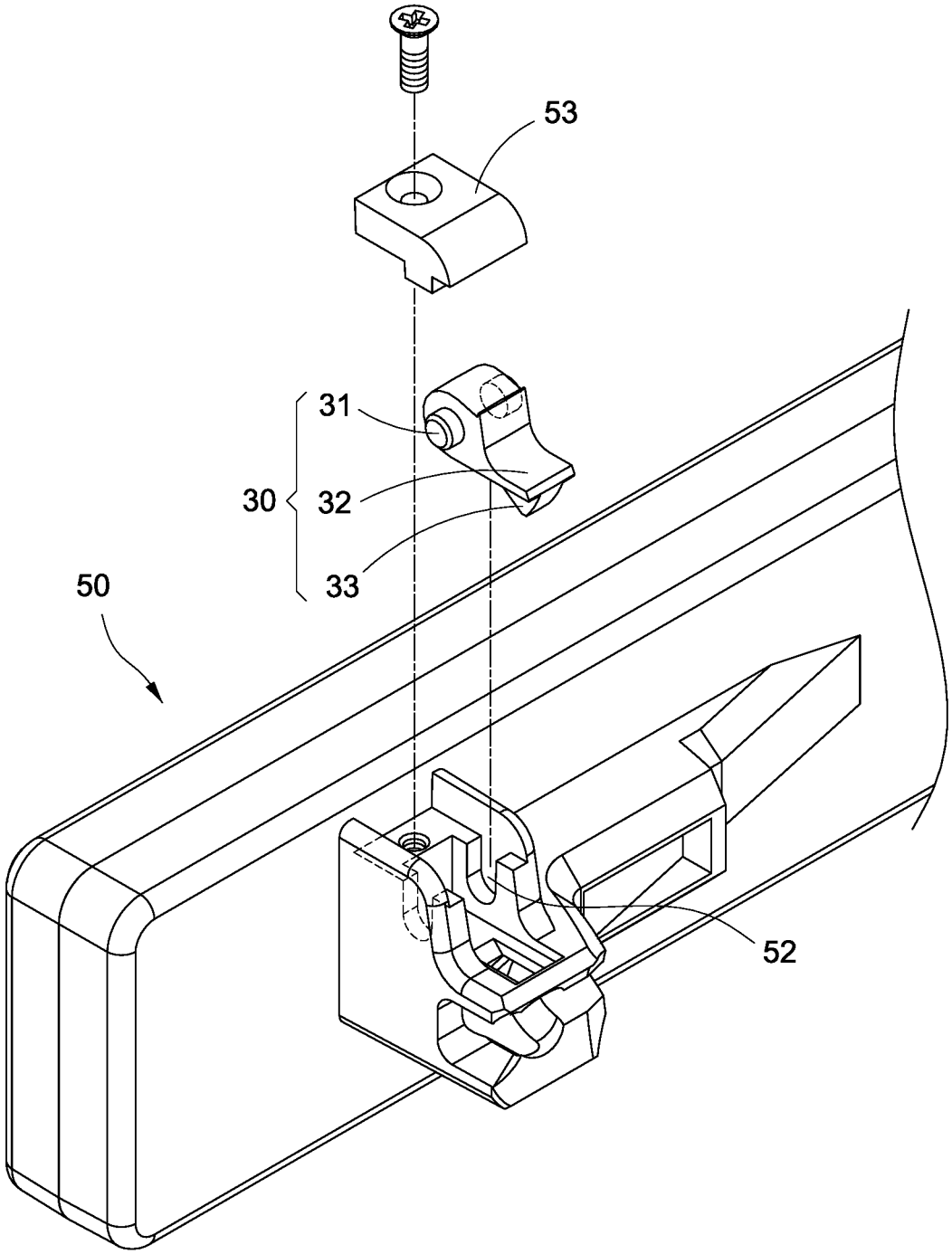
FIG. 4 is a perspective exploded view showing the magazine according to the present disclosure.
Figure 11:
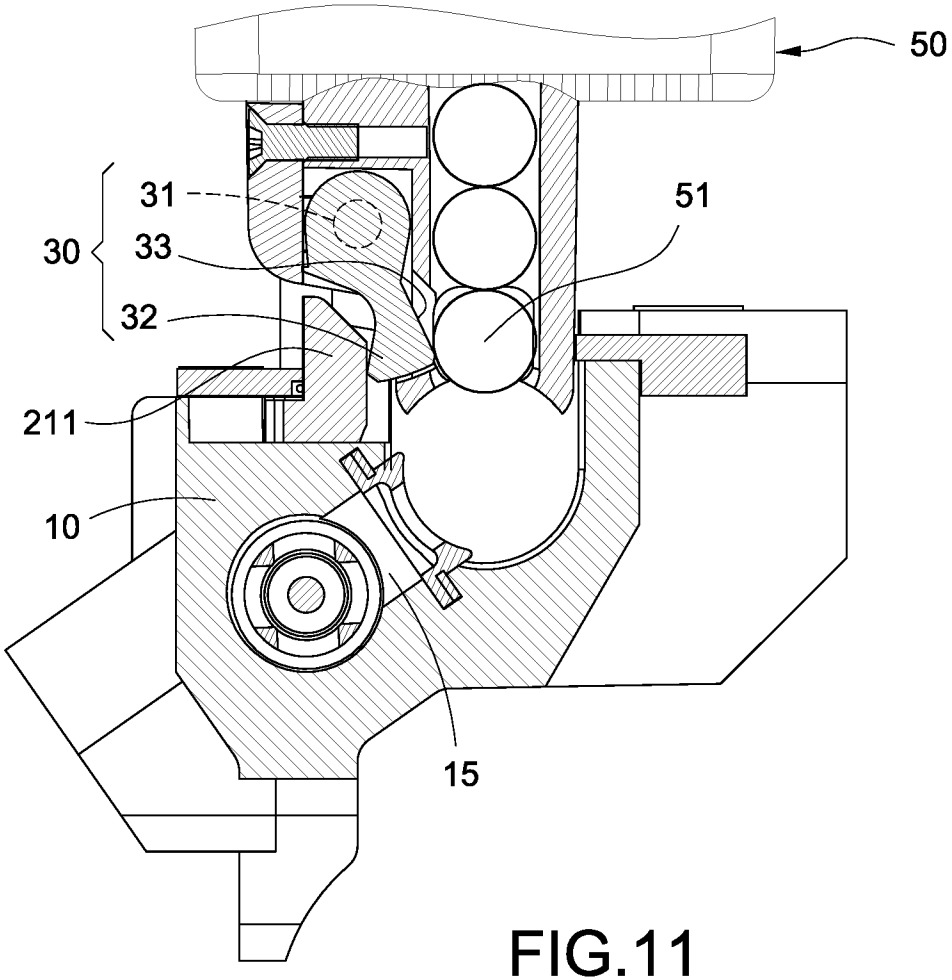
FIG. 11 is a cross sectional side view showing the magazine being loaded with the bullet according to the present disclosure.
Figure 12:
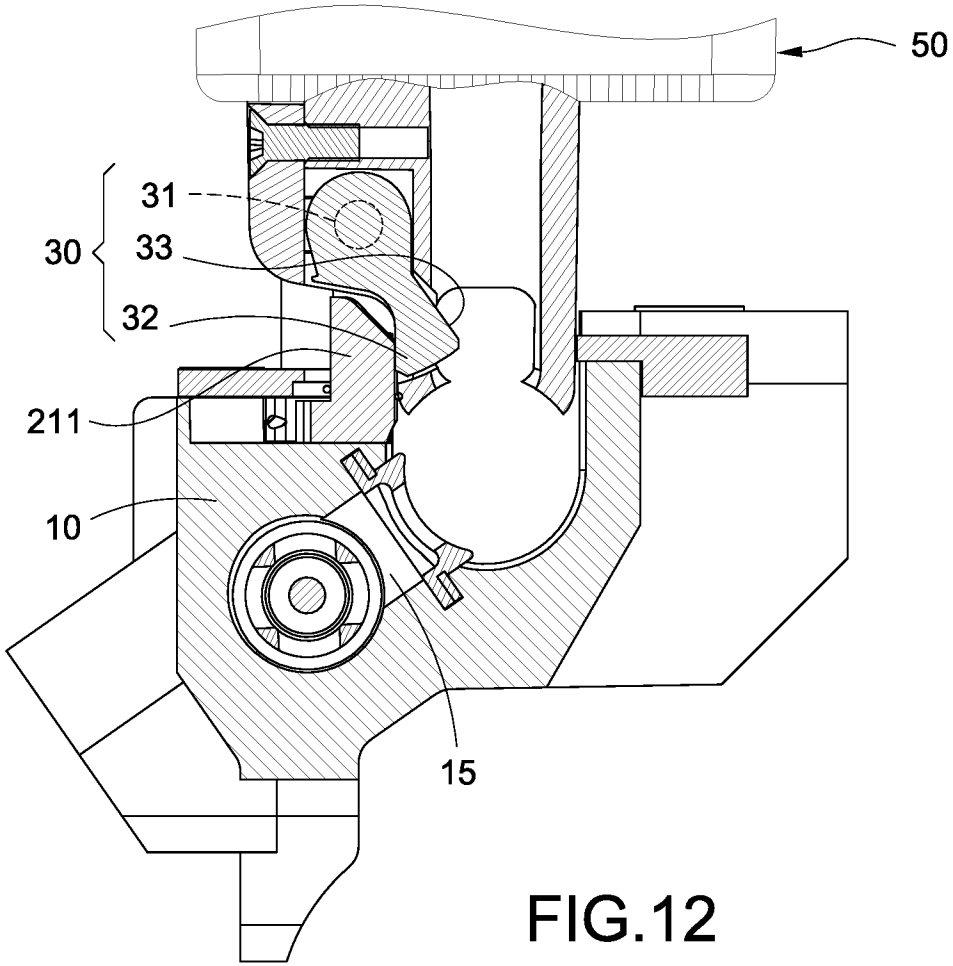
FIG. 12 is a cross sectional side view showing the magazine not being loaded with the bullet according to the present disclosure.

Please refer to FIG. 4, the pulled member 30 has an abut surface 32, and has a second pivotal shaft 31 and a pushed part 33 located on another side of the abut surface 32, and the magazine 50 has a pivotal slot 52 for the second pivotal shaft 31 to be connected pivotally. Please refer to FIG. 11 and FIG. 12, when bullet 51 is loaded in the magazine 50, the bullet 51 outwardly pushes the pushed part 33 to make the pulled member 30 pivotally rotate through the second pivotal shaft 31, so that the abut surface 32 pushes the abut lever 211 to drive the pull lever 21 and push member 23, as shown in FIG. 11. When no bullet 51 is loaded in the magazine 50, the pulled member 30 is in a released status, the abut lever 211 is elastically pressed by the elastic arm 221, the abut lever 211 pushes the abut surface 32 to make the pulled member 30 inwardly retract, and the pushed part 33 retracts to the magazine 50, as shown in FIG. 12.

Details are provided as follows. Please refer to FIG. 5, the no-bullet no-firing structure of the present disclosure further has a top cover 70, and the top cover 70 is locked on the barrel component 10 by utilizing fastening members, for example screws. The elastic member 22 and the pull lever 21 are restricted between the barrel component 10 and the top cover 70, so that the elastic member 22 and the pull lever 21 are prevented from being released. Please refer to FIG. 5, the magazine 50 further has a side cover 53, the side cover 53 covers an outer side of the pulled member 30, and is locked on the magazine 50 by utilizing fastening members, for example screws, so that the pulled member 30 may be prevented from being released from the magazine 50.

Figure 10:
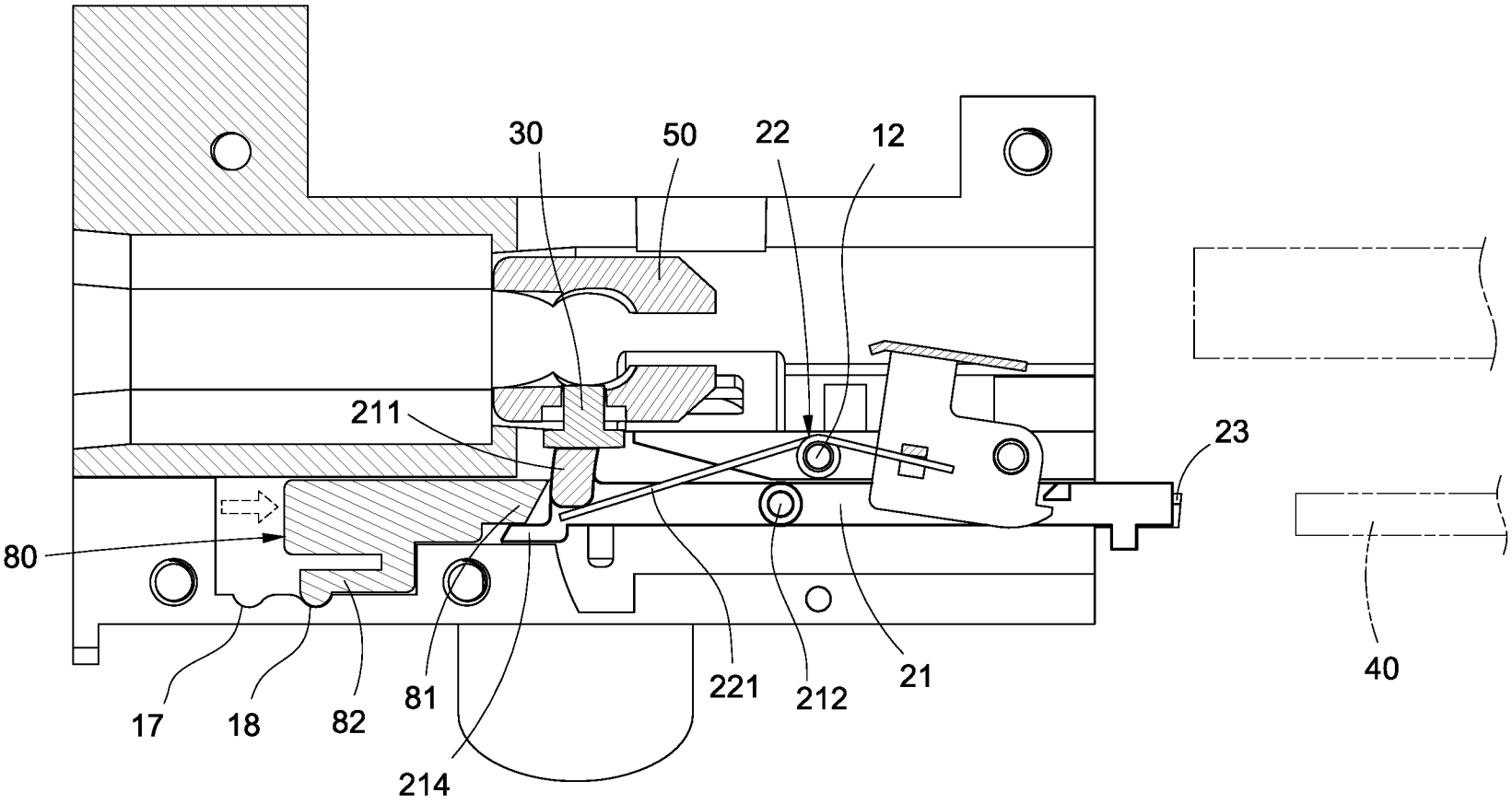
FIG. 10 is a cross sectional top view showing an operating status of the firing switch member according to the present disclosure.

Please refer to FIG. 5, and FIG. 9 to FIG. 10, the no-bullet no-firing structure of the present disclosure further has a firing switch member 80, the firing switch member 80 is disposed switchably on the barrel component 10 and convexly formed with a pull part 83 and an elastic hook 82. The elastic hook 82 is formed in an L-shape and disposed on one lateral side of the firing switch member 80. The barrel component 10 has a first latch slot 17 and a second latch slot 18 for the elastic hook 82 to be latched, and the second latch slot 18 is arranged on one side of the first latch slot 17 close to the pull lever 21. The firing switch member 80 is driven to move through the pull part 83 to make the elastic hook 82 be released from the latch slot where the elastic hook 82 is latched, and the elastic hook 82 inwardly retracts into a slit between the elastic hook 82 and the firing switch member 80 until the elastic hook 82 is latched with any one of the first latch slot 17 and the second latch slot 18, thus the elastic hook 82 may be switched between the first latch slot 17 and the second latch slot 18.

Moreover, a first wedge block 81 is convexly formed on a front end of the firing switch member 80, and the pull lever 21 has a second wedge block 214 convexly formed on one end of the abut lever 211. The second wedge block 214 is pushed by the first wedge block 31 to fasten the pull lever 21, thus the push member 23 and the impact unit 40 may be aligned on the same linear line. When the elastic hook 82 is latched in the first latch slot 17, the first wedge block 81 does not contact with the second wedge block 214, so that the abut lever 211 is elastically pressed by the elastic arm 211 to make the pull lever 21 and the push member 23 be staggeringly arranged with the impact unit 40, as shown in FIG. 9. When the pull part 83 is pulled to make the elastic hook 82 be latched in the second latch slot 18, the first wedge block 81 pushes the second wedge block 214 to make the second wedge block 214 be clamped and fastened between the first wedge block 81 and the barrel component 10, thus the pull lever 21 is fastened and the push member 23 and the impact unit 40 are kept at the same linear line, as shown in FIG. 10. Accordingly, a user may freely select to switch for using a no-bullet no-firing function. Moreover, the pull part 83 may be pulled outside a gun body through other components or mechanisms, thus the pull part 83 is not limited to be directly pulled.

While this disclosure has been described by means of specific embodiments, numerous modifications and variations could be made thereto by those skilled in the art without departing from the scope and spirit of this disclosure set forth in the claims.

What is claimed is:

1. A no-bullet no-firing structure of a toy gun, the toy gun comprising an impact unit;

the no-bullet no-firing structure comprising:

a barrel component:

a switch unit, disposed in the barrel component, and comprising a pull lever, an elastic member and a push member, the pull lever connected pivotally with the barrel component and comprising an abut lever, the elastic member fastened on the barrel component and comprising an elastic arm, the push member connected slidably to the pull lever, and the elastic arm elastically pressing the abut lever; and a magazine unit, disposed on the barrel component and comprising a magazine, at least one bullet and a pulled member, the bullet disposed in the magazine, the pulled member connected pivotally in the magazine corresponding to the abut lever, wherein the pulled member is pushed by the bullet to push the abut lever to make the pull lever, the push member is adapted to be aligned on a same linear line with the impact unit;

wherein when no bullet is loaded in the magazine, the abut lever is pushed by the elastic arm to rotate the pull lever pivotally, and the pull lever drives the push member to jointly swing toward a direction away from the impact unit to make the toy gun incapable of firing.

2. The no-bullet no-firing structure according to claim 1, wherein the pull lever comprises a first pivotal shaft disposed thereon convexly, the barrel component comprises a pivotal hole, and the first pivotal shaft is connected pivotally in the pivotal hole.

3. The no-bullet no-firing structure according to claim 1, wherein the pulled member comprises a second pivotal shaft disposed thereon convexly, the magazine comprises a pivotal slot, and the second pivotal shaft is connected pivotally in the pivotal slot.

4. The no-bullet no-firing structure according to claim 1, wherein the barrel component comprises a round column disposed thereon convexly, and the round column is sleeved by the elastic member.

5. The no-bullet no-firing structure according to claim 1, further comprising a gas inlet valve, and the barrel component comprising a gas chamber, an accommodation slot and a gas channel, wherein the gas inlet valve is disposed in the accommodation slot to control a communication between the gas chamber and the gas channel.

6. The no-bullet no-firing structure according to claim 5, wherein the barrel component further comprises an action chamber, the gas inlet valve comprises a push lever, the push member is disposed slidably in the action chamber to push the push lever to open the gas inlet valve.

7. The no-bullet no-firing structure according to claim 6, wherein the pull lever comprises a position limiting notch disposed on one end of the abut lever, a slide slot is disposed in the action chamber, the push member comprises a first slide part and a second slide part disposed on two ends thereof respectively, the first slide part is slidably restricted in the position limiting notch, and the second slide part is slidably restricted in the slide slot.

8. The no-bullet no-firing structure according to claim 1, wherein the no-bullet no-firing structure further comprises a top cover disposed to cover on the elastic member and the pull lever.

9. The no-bullet no-firing structure according to claim 1, wherein the magazine further comprises a side cover disposed to cover an outer side of the pulled member.

10. The no-bullet no-firing structure according to claim 1, wherein the no-bullet no-firing structure further comprises a firing switch member disposed switchably on the barrel component, the firing switch member comprises a first wedge block, the pull lever comprises a second wedge block convexly disposed on another end of the abut lever, and the second wedge block is pushed by the first wedge block to fasten the pull lever to make the push member and the impact unit be aligned on the same linear line.

11. The no-bullet no-firing structure n according to claim 10, wherein the firing switch member comprises an elastic hook and a pull part, the barrel component comprises a first latch slot and a second latch slot for the elastic hook to be latched, the pull part drives the firing switch member to switch the elastic hook between the first latch slot and the second latch slot.

* * * * *